US009162133B2

(12) United States Patent
Schroer

(10) Patent No.: US 9,162,133 B2
(45) Date of Patent: Oct. 20, 2015

(54) GOLF DIVOT SIMULATOR APPARATUS

(71) Applicant: Scott Allen Schroer, Woodbridge, VA (US)

(72) Inventor: Scott Allen Schroer, Woodbridge, VA (US)

( * ) Notice: Subject to any disclaimer, the term of this patent is extended or adjusted under 35 U.S.C. 154(b) by 171 days.

(21) Appl. No.: 13/966,239

(22) Filed: Aug. 13, 2013

(65) Prior Publication Data

US 2015/0051010 A1 Feb. 19, 2015

(51) Int. Cl.
*A63B 69/36* (2006.01)

(52) U.S. Cl.
CPC ..... *A63B 69/3661* (2013.01); *A63B 69/3623* (2013.01); *A63B 2243/0029* (2013.01)

(58) Field of Classification Search
USPC ..... 473/160, 161, 218, 257, 261, 262, 265, 473/269, 278, 279, 409
See application file for complete search history.

(56) References Cited

U.S. PATENT DOCUMENTS 2,950,120 A * 8/1960 Stewart ..... 482/51
3,352,559 A * 11/1967 Larsen ..... 473/269
5,203,279 A * 4/1993 Eversdyk ..... 119/712
5,273,285 A * 12/1993 Long ..... 473/278
6,001,026 A * 12/1999 Breneman ..... 473/261
D420,407 S * 2/2000 Garcia et al. ..... D21/688
6,666,797 B1 * 12/2003 Martin ..... 482/51
7,549,932 B1 * 6/2009 Miyamoto ..... 473/278
7,625,294 B1 * 12/2009 Isaac et al. ..... 473/218
D648,403 S * 11/2011 Hanifee ..... D21/688
2008/0020856 A1 * 1/2008 Rosa ..... 473/269
2009/0029789 A1 * 1/2009 Davies ..... 473/218
2012/0178546 A1 * 7/2012 Park ..... 473/278

* cited by examiner

*Primary Examiner* — Nini Legesse

(57) ABSTRACT

The golf divot simulator apparatus for simulating the making of the divot associated with striking a golf ball with a golf club, when the golf ball is resting on natural grass turf, incorporates a pivoting structure. The pivoting structure, which includes complementary pivot points, allows the apparatus to rotate away from the path of a swinging golf club that makes contact with the apparatus. The pivoting structure comprises a calculated center of gravity for resetting the apparatus to a ready position via the force of gravity. Thus, subsequent to golf-club-induced rotation of the apparatus, gravity-induced counter rotation resets the apparatus for continued use. The apparatus also incorporates a turf covering for blanketing the pivoting structure. The apparatus further incorporates a fastening mechanism for securing the turf covering to the pivoting structure. The result of the apparatus is a self-resetting practice device that simulates the making of a golf divot.

10 Claims, 5 Drawing Sheets

GOLF DIVOT SIMULATOR APPARATUS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

This invention generally relates to a practice device for striking a golf ball, more particularly, to simulate the making of the divot associated with striking a golf ball with a golf club when the golf ball is resting on natural grass turf. Professional golf instructors commonly teach golf learners to strike a golf ball, resting on natural grass turf, such that the club head of a golf club strikes the golf ball on the downward trajectory of the club head. After striking the golf ball, the club head continues on a downward trajectory which makes contact with the grass turf, thereby tearing up a piece of said grass turf. The piece of grass turf torn up by the club head is called a divot.

A golfer cannot practice striking a golf ball, resting on natural grass turf, repeatedly in the same location because the grass turf practice area will become excessively torn up with divots. An excessively torn up grass turf area is unsuitable for practicing golf. Such a torn up area requires maintenance to restore that area to a suitable condition for practicing golf, and during said maintenance that area is inaccessible. Not having a continuously accessible grass turf practice area is a problem for a golfer who wants to regularly practice striking a golf ball resting on natural grass turf. Additionally, a golfer may choose to practice striking a golf ball in a location of convenience requiring no cost of admittance, for example, in a back yard, on a patio, or indoors. There is a need for a repetitive, suitable, reliable, accessible, convenient, affordable, and portable practice device that simulates the making of the divot associated with striking a golf ball with a golf club when the golf ball is resting on natural grass turf. The intent of this invention is to satisfy said need for a practice device that simulates the making of a divot.

BRIEF SUMMARY OF THE INVENTION

This invention, which simulates the making of a divot, is comprised of a pivoting base, artificial turf, and pegs. Said pivoting base is a solitary component formed out of durable plastic. Said artificial turf, which can be any available variety, is a solitary component and is emplaced on top of the pivoting base. Said pegs, which can be any available variety, are components used to secure the artificial turf to the pivoting base by inserting the pegs, from above, into aligned holes in the turf and base. Said components assembled as indicated embody the apparatus that illustrates the intent of this invention.

The user of this apparatus positions a golf ball at rest within a particular area on top of the artificial turf, addresses the ball, and swings a golf club to strike downward on the ball with the club head of the golf club. After striking downward on the golf ball, the club head continues on a downward trajectory which makes contact with the artificial turf, thereby causing the apparatus to pivot, like a seesaw or teeter-totter, allowing the club head to travel an established trajectory as if the user struck a ball positioned at rest on natural grass turf. After pivoting from contact with a swinging golf club, gravity pivots, or teeters, the apparatus in the opposite direction, which resets the apparatus to a resting position. The result of this apparatus is a self-resetting practice device that simulates the making of the divot associated with striking a golf ball with a golf club when the golf ball is resting on natural grass turf.

If desired, a rigid platform upon which the user stands can be provided in order to raise the bottom of the user's feet to the height of the apparatus. Said platform positions the user's feet and the golf ball upon the same level plane.

Characteristics and advantages of this invention described heretofore, as well as others, will be more intelligible from the accompanying detailed description and drawings which illustrate the intent of this invention.

BRIEF DESCRIPTION OF THE SEVERAL VIEWS OF THE DRAWING

The accompanying drawings illustrate the invention, in which.

DETAILED DESCRIPTION OF THE INVENTION

Figure 1:
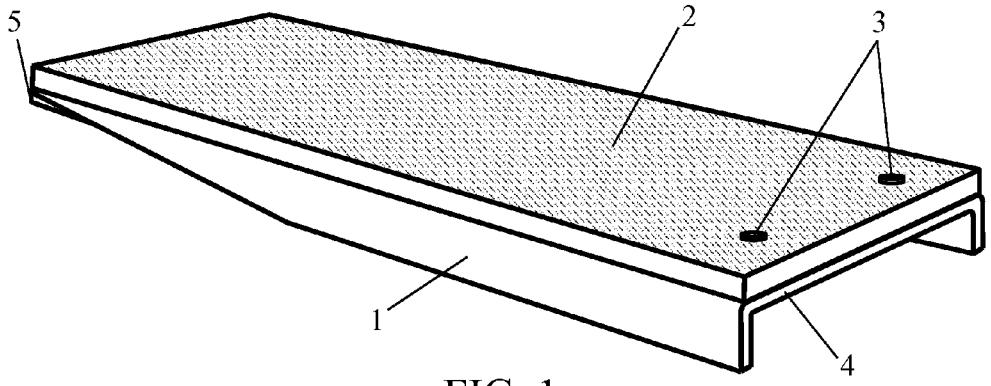
FIG. 1 is a perspective view of the apparatus embodying the invention.

The best mode of carrying out this invention is set forth hereinafter. The drawings illustrate the intent of this invention, but this invention is not limited to any particular embodiment. FIG. 1 is a perspective view of the apparatus embodying the invention, which is a self-resetting practice device that simulates the making of the divot associated with striking a golf ball with a golf club when the golf ball is resting on natural grass turf.

Figure 2:
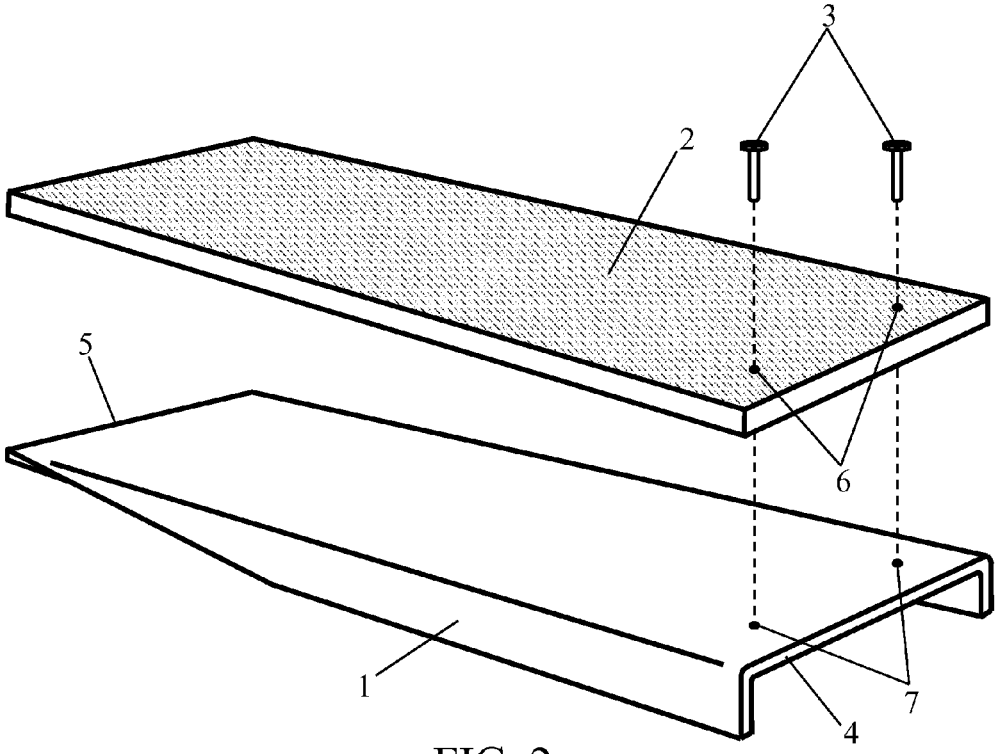
FIG. 2 is an exploded view of the assembly of FIG. 1.

FIG. 2 is an exploded view of the assembly of FIG. 1, which is comprised of a pivoting base 1, artificial turf 2, and pegs 3. The pivoting base 1 is a solitary component formed out of durable plastic, which can be made by cutting the appropriate shape from a flat sheet of durable plastic, applying suitable heat to the appropriate areas of said plastic, and bending said plastic into the shape as illustrated in FIG. 2. The artificial turf 2, which can be any available variety, is a solitary component which is cut to the appropriate size and emplaced on top of the pivoting base 1 as illustrated in FIG. 1. The pegs 3, which can be any available variety, are components used to secure the artificial turf 2 to the pivoting base 1 by aligning the peg holes 6 in the artificial turf 2 with the peg holes 7 in the pivoting base 1, and inserting the pegs 3, from above, into the peg holes as illustrated in FIG. 2. The peg holes 6 in the artificial turf 2 and the peg holes 7 in the pivoting base 1 can be drilled to the appropriate size to accommodate the pegs 3. The pivoting base 1, artificial turf 2, and pegs 3 assembled as shown in FIG. 1 embody the apparatus that illustrates the intent of this invention.

Figure 3:
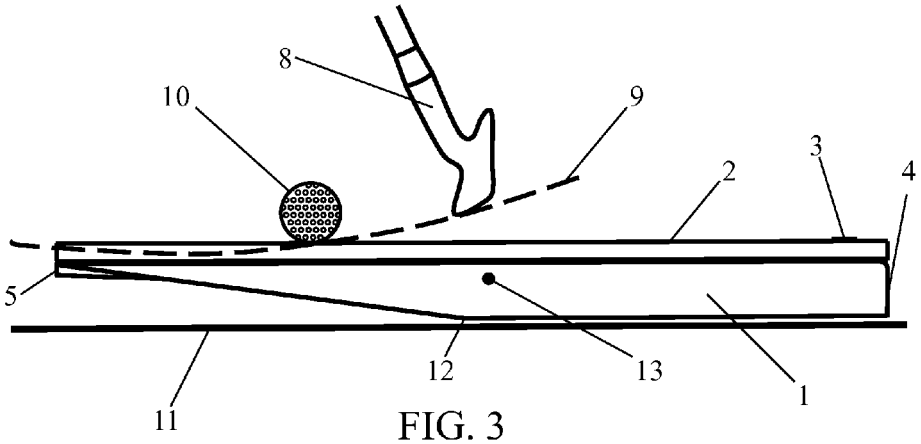
FIG. 3 is a side view of the structure of FIG. 1, showing the apparatus at rest with a swinging golf club traveling along an established trajectory approaching a positioned golf ball.
Figure 4:
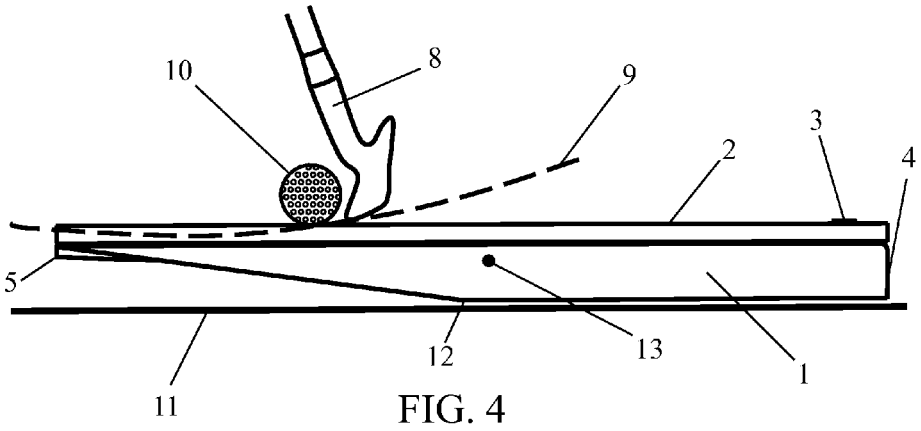
FIG. 4 is a side view of the structure of FIG. 1, showing the apparatus at rest just prior to contact with a swinging golf club traveling along an established trajectory about to strike a positioned golf ball.
Figure 5:
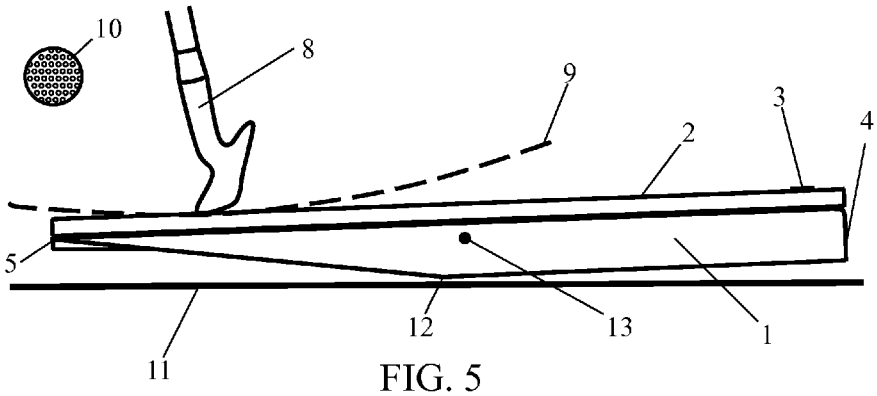
FIG. 5 is a side view of the structure of FIG. 1, showing the apparatus reacting to contact with a swinging golf club traveling along an established trajectory just after striking a positioned golf ball.
Figure 6:
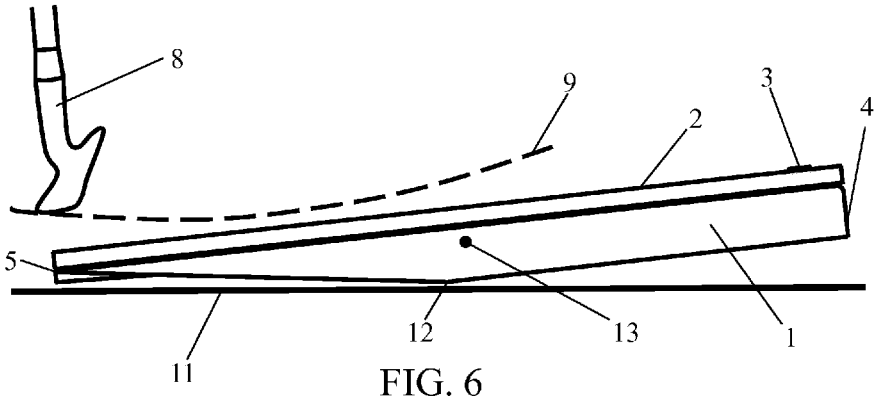
FIG. 6 is a side view of the structure of FIG. 1, showing the apparatus continuing to react after contact with a swinging golf club traveling along an established trajectory.
Figure 7:
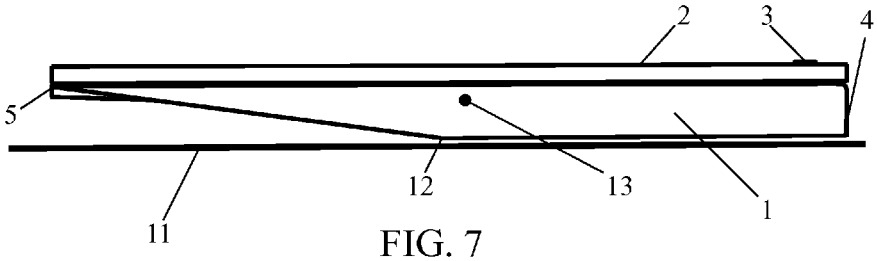
FIG. 7 is a side view of the structure of FIG. 1, showing the apparatus settled at rest after reacting to contact with a swinging golf club.

To use, the apparatus is placed upon the ground 11 (or floor) as shown in FIG. 3, which is a side view of the structure of FIG. 1, showing the apparatus at rest with a swinging golf club 8 traveling along an established trajectory 9 approaching a positioned golf ball 10. The user of the apparatus positions a golf ball 10 at rest upon the artificial turf 2 between the fore end 5 of the apparatus and the pivot point 12 of the apparatus. Take notice that a matching pivot point on the opposite side of the apparatus is not visible in the drawings. The user addresses the ball 10 and swings a golf club 8 to strike downward on the ball 10 with the club head of the golf club 8. FIG. 4 is a side view of the structure of FIG. 1, showing the apparatus at rest just prior to contact with a swinging golf club 8 traveling along an established trajectory 9 about to strike a positioned golf ball 10. After striking downward on the golf ball 10, the club head continues on a downward trajectory 9 which makes contact with the artificial turf 2, thereby causing the apparatus to pivot at the pivot point 12 of the apparatus, like a seesaw or teeter-totter, allowing the club head to travel an established trajectory 9 as if the user struck a ball positioned at rest on natural grass turf. FIG. 5 is a side view of the structure of FIG. 1, showing the apparatus reacting to, or pivoting from, contact with a swinging golf club 8 traveling along an established trajectory 9 just after striking a positioned golf ball 10. Said contact creates torque about the pivot point 12 which causes the apparatus to rotate around the pivot point 12, thereby allowing the apparatus to genuinely yield to the golf club 8 and simulate the making of a divot in natural grass turf. Rotation around an integrated pivot point caused by user-provided torque is a distinct characteristic and advantage of the apparatus. FIG. 6 is a side view of the structure of FIG. 1, showing the apparatus continuing to react, or pivot, after contact with a swinging golf club 8 traveling along an established trajectory 9. After pivoting from said contact with a swinging golf club 8, the force of gravity acting on the center of gravity 13 of the apparatus, located between the pivot point 12 and the aft end 4 of the apparatus, creates counter-torque about the pivot point 12 which causes the apparatus to rotate around the pivot point 12 in the opposite direction, thereby resetting the apparatus to a resting position ready to simulate the making of a divot in natural grass turf. FIG. 7 is a side view of the structure of FIG. 1, showing the apparatus settled at rest after reacting to, or pivoting from, contact with a swinging golf club 8 and the pull of gravity. Reset via gravity is a distinct characteristic and advantage of the apparatus.

Figure 8:
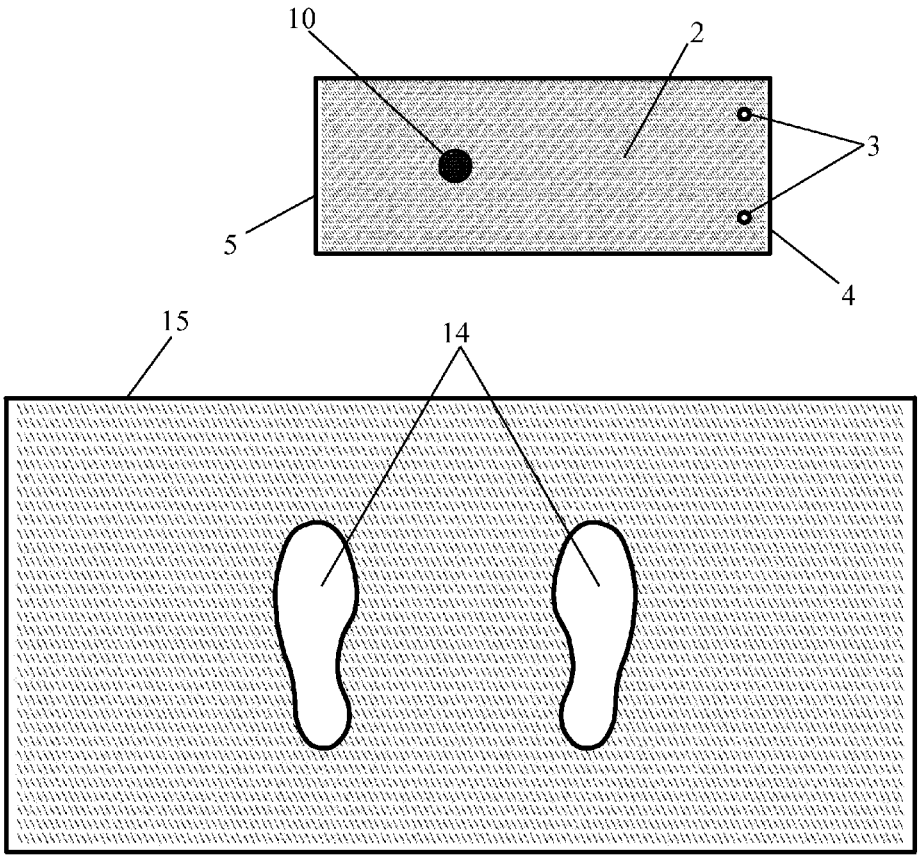
FIG. 8 is an overhead view of the structure of FIG. 1, showing the apparatus at rest with a positioned golf ball, adjacent to a platform that can be employed to elevate a user's feet.

A rigid platform upon which the user stands can be provided in order to raise the bottom of the user's feet to the height of the apparatus. FIG. 8 is an overhead view of the structure of FIG. 1, showing the apparatus at rest with a positioned golf ball 10, adjacent to a platform 15 that can be employed to elevate a user's feet 14. Said platform 15 positions the user's feet 14 and the golf ball 10 upon the same level plane. FIG. 8 also shows the apparatus, relative to a user's feet 14, configured for right-handed-golfer use with the fore end 5 on the user's left and the aft end 4 on the user's right. The apparatus, as depicted in FIG. 8, can be turned 180 degrees in a counterclockwise direction for left-handed-golfer use, which places the fore end 5 on the user's right and the aft end 4 on the user's left.

The disclosed drawings are illustrative, not restrictive. While a particular configuration of this invention has been described, the illustrated intent of this invention can be achieved via a variety of configurations. The illustrated intent of this invention is bounded only by the claims associated with this invention.

What is claimed is:

1. A method for simulating the making of a divot associated with striking a golf ball with a golf club when the golf ball is resting on natural grass turf, comprising:

positioning a pivoting structure, including a base having a lower fore end portion, a lower rear end portion and a top portion, on a supporting surface in a first position forward of a golfer standing directly on the supporting surface, with said base being adapted to rest on the supporting surface with the lower rear end portion engaging the supporting surface and the lower fore end portion being angled form the lower the lower read end portion so as to be spaced from the supporting surface;

rotating the pivoting structure to a second position away from a path of a swinging golf club upon contacting the top portion of the base at the fore end portion with the golf club, wherein the base pivots to raise the lower rear end portion and lower the lower fore end portion to simulate the taking of a divot; and providing for counter rotation of the structure back to the first position, wherein the lower rear end portion reengages the supporting surface.

2. The method of claim 1, wherein the pivoting structure comprises complementary pivot points.

3. The method of claim 1, wherein the pivoting structure comprises a calculated center of gravity for resetting the structure to a ready position via the force of gravity.

4. The method of claim 1, wherein the gravity-induced counter rotation is automatically performed after the golf club is no longer in contact with the structure.

5. The method of claim 1 wherein the counter rotation is gravity-induced.

6. A golf divot simulator apparatus for simulating the taking of a divot in a ground surface associated with striking a golf ball by a golfer with a golf club when the golf ball is resting on natural grass turf, comprising: a base adapted to be positioned forward of the golfer, said base including a lower fore end portion, a lower rear end portion and a top portion, with said base being adapted to rest on a supporting surface with the lower rear end portion engaging the supporting surface and the lower fore end portion being angled from the lower rear end portion so as to be spaced from the supporting surface wherein, when the golfer contacts the top portion of the base at the fore end portion with a swinging golf club, the base pivots to raise the lower rear end portion and lower the lower fore end portion to simulate the taking of a divot, followed by the base counter-rotating such that the lower rear end portion reengages the supporting surface.

7. The apparatus of claim 6, further comprising: a turf covering for blanketing the top portion.

8. The apparatus of claim 7, further comprising: a fastening mechanism for securing the turf covering to the base.

9. The apparatus of claim 6, wherein the base is adapted to be positioned forward of the golfer as the golfer stands directly on the supporting surface.

10. The apparatus of claim 6, wherein base is configured such that the counter-rotating of the base is gravity-induced.

* * * * *